United States Patent [19]

Bogden

[11] Patent Number: 4,463,728

[45] Date of Patent: Aug. 7, 1984

[54] ENGINE SYNC PULSE GENERATOR FOR A FUEL INJECTION SYSTEM

[75] Inventor: Dennis M. Bogden, Grand Blanc, Mich.

[73] Assignee: General Motors Corporation, Detroit, Mich.

[21] Appl. No.: 479,487

[22] Filed: Mar. 28, 1983

[51] Int. Cl.[3] ..... F02B 3/00

[52] U.S. Cl. ..... 123/475; 123/494

[58] Field of Search ..... 123/475, 494, 478, 490, 123/415, 418

[56] References Cited

U.S. PATENT DOCUMENTS

| | | | |
|---|---|---|---|
| 1,002,949 | 9/1911 | Wiley | 123/475 |
| 3,314,407 | 9/1964 | Schneider | 123/475 |
| 3,855,973 | 12/1974 | Scofield | 123/475 |
| 4,058,709 | 11/1977 | Long | 123/475 |
| 4,398,516 | 8/1983 | Momoyama | 123/418 |
| 4,407,246 | 10/1983 | Boyama | 123/415 |

FOREIGN PATENT DOCUMENTS

| | | | |
|---|---|---|---|
| 2242795 | 3/1974 | Fed. Rep. of Germany | 123/475 |

*Primary Examiner*—Raymond A. Nelli

*Attorney, Agent, or Firm*—Howard N. Conkey

[57] ABSTRACT

A system is described for generating an engine camshaft sync pulse having a constant predetermined crankshaft angle relation to the top dead center position of a designated one of the cylinders of the engine to enable synchronization of the fuel injection sequence with the ignition sequence without the requirement of a camshaft position sensor.

3 Claims, 2 Drawing Figures

ENGINE SYNC PULSE GENERATOR FOR A FUEL INJECTION SYSTEM

This invention relates to a method and apparatus for generating a sync pulse having a predetermined crankshaft position of a designated one of the cylinders of an internal combustion engine.

In sequential fuel injection systems for internal combustion engines, fuel to each of the cylinders is injected in timed relationship to the position of the cylinder piston in its cycle and in synchronism with the cylinder ignition sequence. Typically, sequential fuel injection is timed relative to reference pulses, each injection event having an engine operation dependent crankshaft angle relation to the top dead center crankshaft position of a respective one of the cylinders. These reference pulses may take the form of ignition reference pulses each being generated at a constant crankshaft angle relationship to top dead center of a respective one of the cylinders by the distributor in a conventional ignition system. However, the reference pulses alone are unidentifiable with a particular cylinder so that some means must be provided to identify when at least one of the engine cylinders is at a particular point in its cycle. When this point is identified, the sequential fuel injection pulses to the cylinders may be provided in timed relationship to the reference pulses and in synchronism with the cylinder ignition sequence.

Typically, the means for identifying when one of the cylinders selected to be the reference cylinder is at a particular point in its cycle takes the form of a camshaft position sensor which may include a magnet rotated by the camshaft and which is sensed at a camshaft angle corresponding to the particular point in the cycle of the reference cylinder by a Hall effect sensor. Once the magnet position has been sensed by the Hall effect sensor, the crankshaft reference pulses may then be identifiable with particular cylinders so that the sequential fuel injection may be synchronized with the ignition sequence of the engine.

The present invention provides for the generation of a camshaft sync pulse having a constant predetermined crankshaft angle relation to the top dead center position of a designated one of the cylinders so as to enable synchronization of the fuel injection sequence with the ignition sequence without the requirement of a camshaft position sensor. The camshaft sync pulse is generated by utilizing reference pulses each having a predetermined crankshaft angle relation to top dead center position of a respective one of the cylinders and the ignition event in a predetermined reference cylinder.

Figure 1:
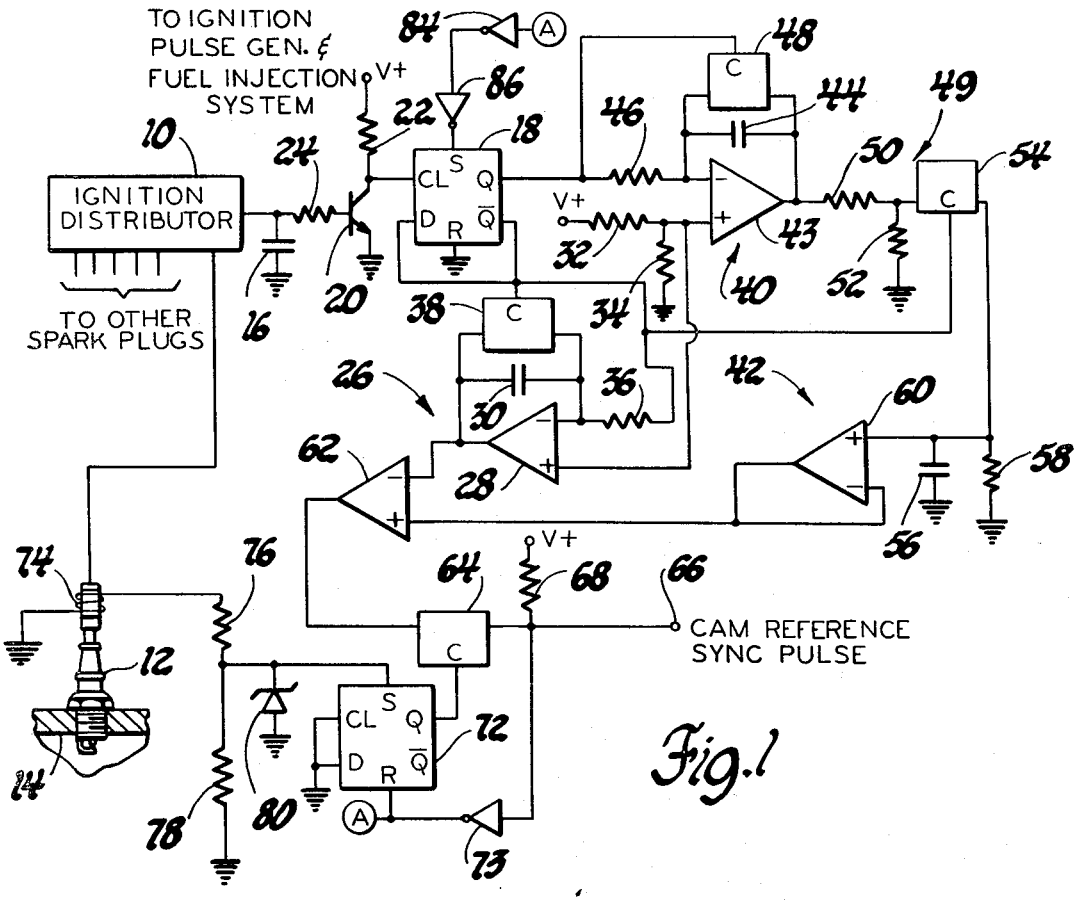
Figure 2:
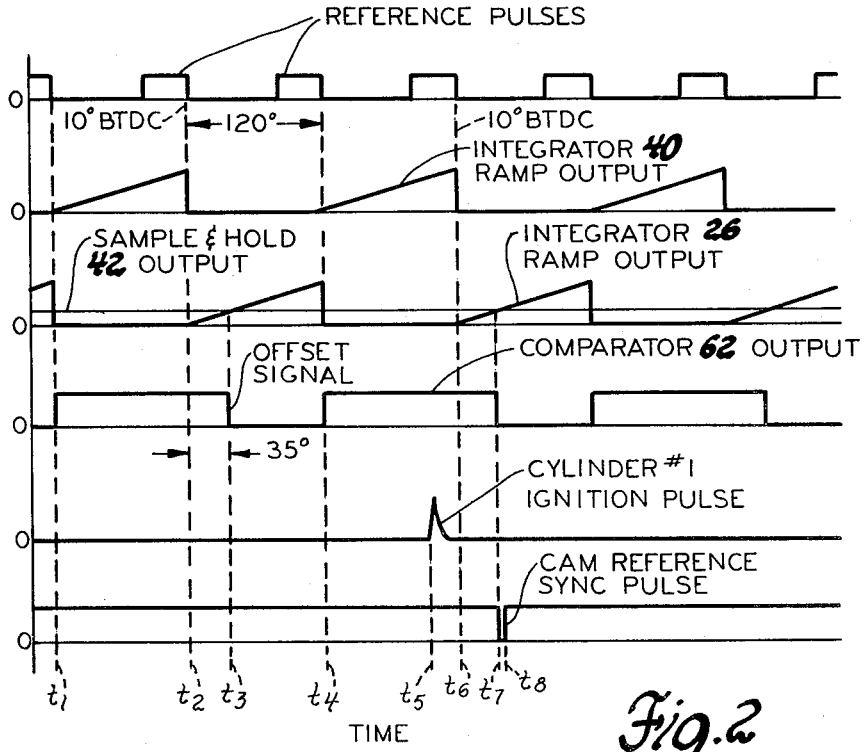

The invention may be best understood by reference to the following description of a preferred embodiment of the invention and the drawings in which:

FIG. 1 is a schematic drawing of a circuit for generating a sync pulse at a predetermined crankshaft angle relation to the top dead center crankshaft position of a designated one of the cylinders of an internal combustion engine in accord with the principles of this invention; and FIG. 2 is a timing diagram illustrating the operation of the circuit of FIG. 1.

Referring to FIG. 1, a conventional ignition distributor 10 for a 6-cylinder internal combustion engine supplies timed ignition pulses in a predetermined sequence to the spark plugs of the six cylinders, spark plug 12 of cylinder number 1 being specifically illustrated. Spark plug 12 is mounted in the engine block 14 for igniting the combustible mixture supplied to cylinder number 1 when an ignition pulse is provided thereto from the distributor 10.

The ignition distributor 10 includes a conventional signal generator for generating reference pulses as illustrated in FIG. 2 spaced at 120 crankshaft degrees with each trailing edge occurring at, for example, 10 degrees before top dead center of the power stroke of one of the cylinders. The reference signal generator in the ignition distributor 10 may take the form of a conventional star wheel signal generator and pulse output circuit which generates the reference pulses as illustrated in FIG. 2, the falling edge of each occurring at 10 degrees crankshaft angle before top dead center of a cylinder power stroke. These sequential reference pulses are developed across a filter capacitor 16 and applied to a conventional ignition pulse generator for the purpose of supplying ignition pulses via the ignition distributor to the spark plugs in timed relationship to engine rotation to establish the ignition timing requirements of the internal combustion engine and to a sequential fuel injection system to establish injection timing.

The reference pulses from the distributor 10 also function to toggle a D-type flip-flop 18 via an NPN transistor 20 whose emitter and collector are series coupled with a resistor 22 between a positive voltage V+ and ground and whose collector is coupled to the clock input of the flip-flop 18. The $\overline{Q}$ output of the flip-flop 18 is coupled to its D input so that the Q and $\overline{Q}$ outputs each shift between high and low voltage states with each positive going transition of the voltage at its clock input. Each reference pulse from the distributor 10 is coupled to the base of the transistor 20 via a resistor 24 and biases the transistor 20 conductive to ground the clock input of the flip-flop 18. At the trailing edge of each reference pulse, the transistor 20 is biased off and its collector voltage increases to the voltage V+ to toggle the flip-flop 18.

The $\overline{Q}$ output of the flip-flop 18 controls an integrator 26 which generates a periodic ramp signal beginning at the trailing edge of a reference pulse at 10 degrees before top dead center crankshaft angle of one of the cylinders and increasing at a constant rate from ground potential over a 120 degree crankshaft angle. In effect, the instantaneous amplitude of the ramp signal represents the elapsed time since the trailing edge of the last generated reference pulse. The instantaneous value of the integrator 26 ramp output relative to the value after 120° of crankshaft rotation represents the crankshaft angular rotation since the trailing edge of the last reference pulse.

The integrator 26 includes an operational amplifier 28 having an integrating capacitor 30 coupled between its negative input and its output. A constant positive voltage is provided to the positive input of the amplifier 28 by a voltage divider comprised of resistors 32 and 34 coupled between the positive voltage V+ and ground. The $\overline{Q}$ output of the flip-flop 18 is coupled to the negative input of the amplifier 28 through a resistor 36. A bilateral switch 38 is coupled in parallel with the capacitor 30 and has its control input coupled to the $\overline{Q}$ output of the flip-flop 18. The bilateral switch 38 is conventional in form and has a normally high impedance state. The switch is switched to a low impedance state when a positive voltage is applied to its control input. An example of such a switch is the CD4016 bilateral switch manufactured by National Semiconductor.

When the $\overline{Q}$ output of the flip-flop 18 is in its low voltage state, the bilateral switch 38 is in its high impedance state and the positive input to the integrator 26 is higher than its negative input from the $\overline{Q}$ output of the flip-flop 18. When this condition exists, the output of the integrator 26 ramps in a positive direction at a constant rate. When the $\overline{Q}$ output is toggled to its high voltage state, the negative input of the integrator 26 shifts to a high level exceeding its positive input and the bilateral switch 38 is shifted to its low impedance state to discharge the capacitor 30. In response to these conditions, the output of the integrator 26 is rapidly shifted to ground potential. This state is maintained until such time that the $\overline{Q}$ output of the flip-flop 18 is again toggled to its low voltage state at which time the output of the integrator 26 again begins to ramp at the predetermined constant rate from ground potential. Since the $\overline{Q}$ output of the flip-flop 18 is toggled at each 120 crankshaft degrees by the reference pulses, the integrator 26 output is maintained at ground potential for a period of 120 crankshaft degrees after which it ramps positive for a period of 120 crankshaft degrees, the instantaneous value of the ramp output of the integrator 26 relative to the value after 120 crankshaft degrees representing the crankshaft angular relationship to the trailing edge of the reference pulse that toggled the $\overline{Q}$ output to its low voltage state.

The Q and $\overline{Q}$ outputs of the flip-flop 18 combine to control a circuit including an integrator 40 and a sample and hold circuit 42 which generates a voltage representing a predetermined desired crankshaft angle between the desired crankshaft angle location of the sync pulse and the trailing edge of the prior reference pulse. In this embodiment, a voltage is provided at the output of the sample and hold circuit 42 representing 35 degrees of crankshaft rotation after the trailing edge of a reference pulse which corresponds to 25 degrees after top dead center of the respective cylinder.

The integrator 40 is identical to the integrator 26 and has the same gain. The integrator 40 includes an operational amplifier 43 having an integrating capacitor 44 coupled between its negative input and its output. A constant positive voltage is provided to the positive input of the amplifier 43 from the voltage divider comprised of the resistors 32 and 34. The Q output of the flip-flop 18 is coupled to the negative input of the amplifier 43 through a resistor 46. A bilateral switch 48 is coupled in parallel with the capacitor 44 and has its control input coupled to the Q output of the flip-flop 18.

When the Q output of the flip-flop 18 is in its high voltage state, the negative input of the integrator 40 exceeds its positive input and the bilateral switch 48 is in its low impedance state to discharge the integrating capacitor 44. In response to these conditions, the output of the integrator 40 is held at ground potential. When the flip-flop 18 is then toggled so that its Q output shifts to its low voltage state, the bilateral switch 48 is switched to its high impedance state and the integrator 40 provides a ramp signal increasing at the same rate as the ramp signal provided by the integrator 26 when the $\overline{Q}$ output is in its low voltage state. Since the Q output of the flip-flop 18 is toggled at each 120 crankshaft degrees by the reference pulses, the integrator 40 output is maintained at ground potential for a period of 120 crankshaft degrees after which it ramps positive for a period of 120 crankshaft degrees, the instantaneous value of the ramp relative to the value after 120 crankshaft degrees representing the crankshaft rotation since the trailing edge of the prior reference pulse.

The output signal from the integrator 40 is coupled across a voltage divider 49 comprised of a resistor 50 and a resistor 52. The ratio of the resistance of resistor 52 to the sum of the resistances of the resistors 50 and 52 is made equal to Y/X where X is the crankshaft angle between reference pulses (120° in this embodiment) and Y is the crankshaft angle between the desired crankshaft angle location of the sync pulse and the trailing edge of the prior reference pulse (35° corresponding to 25° after top dead center in this embodiment). Therefore, the voltage established by the voltage divider 49 is equal to Y/X times the amplitude of the ramp output signal from the integrator 40.

The voltage signal established by the voltage divider 49 is coupled to one side of a bilateral switch 54 the other side of which is coupled to a filter circuit comprised of a capacitor 56 and a resistor 58 in the sample and hold circuit 42. The sample and hold circuit 42 also includes a unity gain buffer amplifier 60. The voltage across the filter is coupled to the positive input of the buffer amplifier 60. The control input to the bidirectional switch 54 is coupled to the $\overline{Q}$ output of the flip-flop 18 so that when the Q output is in its low state enabling the integrator 40 to generate the ramp signal at its output, the bidirectional switch 54 is set in its low impedance state to couple the voltage from the voltage divider 49 directly across the capacitor 56 which is charged substantially instantaneously to the voltage established by the voltage divider 49. When the flip-flop 18 is next toggled by a reference pulse, the bidirectional switch 54 is set to its high impedance state by the $\overline{Q}$ output of the flip-flop 18. The capacitor 54 and resistor 56 have a substantially large time constant so that the peak value of the voltage provided by the voltage divider 49, which is Y/X times the peak value of the ramp signal output of the integrator 40, is stored across the capacitor 56 and provided at the output of the unity gain buffer amplifier 60.

The ramp output of the integrator 26 representing the instantaneous crankshaft angular relationship to the trailing edge of the prior reference pulse and the output of the sample and hold circuit 42 representing a predetermined desired crankshaft angle between the desired crankshaft angle location of the sync pulse and the trailing edge of the prior reference pulse are provided to the negative and positive inputs, respectively, of a comparator 62. When the output of the sample and hold circuit 42 is greater than the ramp signal provided by the integrator 26, the output of the comparator 62 is a high voltage level. Conversely, when the ramp signal from the integrator 26 exceeds the output of the sample and hold circuit 42, the output of the comparator switch 62 is at a low voltage or ground level.

The output of the comparator switch 62 is provided to one side of a bilateral switch 64 whose output is coupled to an output terminal 66. The output terminal is also coupled to the voltage V+ via a resistor 68. As long as the bilateral switch 64 is in its high impedance condition, the output of the circuit at output terminal 66 is at the voltage of the positive voltage source V+. When the bilateral switch 64 is in its low impedance condition, the output signal on output terminal 66 is at the voltage level of the output of the comparator switch 62.

The bilateral switch 64 is set to its low impedance state when the distributor 10 supplies an ignition signal to the number 1 cylinder spark plug 12. Thereafter, the bilateral switch 64 is maintained in its low impedance state until the output of the comparator switch 62 shifts to ground potential. The bilateral switch 64 is then shifted again to its high impedance state.

The control of the bilateral switch 64 is provided by means of a D-type flip-flop 72 that is set in response to an ignition pulse being supplied to the number 1 cylinder spark plug 12 and reset via an inverter 73 in response to the voltage at the output terminal 66 shifting to ground potential. In this respect, the ignition signal provided to the spark plug 12 is sensed by a winding 74 around the ignition wire between the ignition distributor 10 and the spark plug 12. The ignition signal induces a voltage pulse in the coil 74 which is applied across the series combination of a resistor 76 and a resistor 78. The voltage pulse developed across the resistor 78 is applied to the set input of the flip-flop 72 which is set by the leading edge thereof. A Zener diode 80 is provided to limit the voltage applied to the set input of the flip-flop 72.

When set by the ignition pulse to the spark plug 12, the Q output of the flip-flop 72 shifts to a high voltage state which sets the bilateral switch 64 to its low impedance state as previously described. When the output of the comparator switch 62 next shifts to ground, and pulls the output terminal to ground, the flip-flop 72 is reset via the inverter 73. The short duration ground level pulse appearing at output terminal 66 comprises the cam reference sync pulse provided in accord with this invention. The reset pulse output of the inverter 73 is also applied through a pair of inverters 84 and 86 to the set input of the flip-flop 18 which is set upon the generation of the low level output at the output terminal 66 to establish the correct phase relationship in the Q and $\overline{Q}$ outputs of the flip-flop 18 with the cylinders of the engine.

The operation of the circuit of FIG. 1 will now be described with reference to the timing diagram of FIG. 2. In this description it will be assumed that the trailing edge of each of the reference pulses provided by the ignition distributor 10 occurs at 10 degrees before top dead center of one of the cylinders and that it is desired to generate the cam reference sync pulse at 25 degrees after top dead center crankshaft position of cylinder number 1 in its power stroke.

At time $t_1$, a reference pulse output of the ignition distributor 10 toggles the flip-flop 18 whose Q output shifts to its low voltage state and $\overline{Q}$ output shifts to its high voltage state. The low voltage state of the Q output sets the bilateral switch 48 in its high impedance state to enable the integrator 40 to begin ramping its output from ground potential at a constant rate. The $\overline{Q}$ output sets the bilateral switch 54 in its low impedance state to couple the ramp output of the voltage divider 49 to the sample and hold circuit 42 and also sets the bilateral switch 38 in its low impedance state to discharge the capacitor 30 and set the output of the integrator 26 at ground potential. When the integrator 26 output is reset to ground, the output of the comparator 62 shifts to a high voltage level. The foregoing conditions exist for 120 crankshaft degrees after which at time $t_2$ the trailing edge of the next reference pulse at 10 degrees before top dead center of one of the cylinders again toggles the flip-flop 18. At this time, the Q output of the flip-flop 18 shifts to a high voltage state to set the bilateral switch 48 in its low impedance state. The capacitor 44 is discharged through the switch 48 to set the output of the integrator 40 at ground potential. The low voltage state of the $\overline{Q}$ output sets the bilateral switch 38 in its high impedance state to enable the integrator 26 to begin ramping at a constant rate. Also at time $t_2$, the bilateral switch 54 is set in its high impedance state to isolate the output of the integrator 40 from the sample and hold circuit 42.

The peak amplitude of the ramp signal provided by the integrator 40 at time $t_2$ represents 120 degrees of crankshaft rotation, the angular rotation between the trailing edge of two consecutive reference pulses. The voltage charge of the capacitor 56 in the sample and hold circuit 42 at the time $t_2$ is the predetermined fraction of the peak output of the ramp signal provided by the integrator 40 at time $t_2$ as established by the voltage divider 49. As previously described, the ratio of the resistors 50 and 52 are such that the charge across the capacitor at time $t_2$ when the bidirectional switch 54 is set to its high impedance state is equal to Y/X times the peak amplitude of the ramp signal provided by the integrator 40 where X is 120° crankshaft degrees between reference pulses and where Y is the crankshaft angle of 35 degrees between the desired crankshaft position of the cam sync pulse and the trailing edge of the prior reference pulse. In this respect, it is recalled that it is desired to generate the cam sync pulse at 25 degrees after top dead center of cylinder number 1 and that the trailing edge of the prior reference pulse occurs at 10 degrees before top dead center of cylinder number 1. Therefore, at time $t_2$, the charge across the capacitor 56 and accordingly the output of the sample and hold circuit 42 applied to the positive input of the comparator switch 62 is a voltage that is equal to the ramp signal output of either of the integrators 26 or 40 after a crankshaft rotation of 35 degrees following the trailing edge of the respective reference pulse.

At time $t_3$, the crankshaft angular rotation following the trailing edge of the reference pulse at time $t_2$ is equal to 35 degrees at which time the output of the integrator 26 is equal to the output of the sample and hold circuit 42. At this time, the output of the comparator switch 62 coupled to the bilateral switch 64 shifts from its high voltage state to its low voltage state. This transition comprises an offset signal occurring 35 crankshaft degrees after the trailing edge of the prior reference pulse. However, the Q output of the flip-flop 72 is in its low voltage state so that the bilateral switch 64 is in its high impedance state. Accordingly, the output voltage at the output terminal 66 remains at the positive voltage V+.

At time $t_4$, the trailing edge of the next reference pulse toggles the flip-flop 18 and the circuit conditions previously established at time $t_1$ are again established.

At time $t_5$, an ignition pulse is provided by the ignition distributor 10 to the spark plug 12 of reference cylinder number 1. This pulse induces a voltage pulse in the winding 74 to provide a set pulse to the flip-flop 72. The Q output of the flip-flop 72 is toggled to its high voltage state which sets the bidirectional switch 64 in its low impedance state. Since the output of the comparator switch 62 is at its high voltage state, the negative input thereto being at ground potential and the positive input thereto being the predetermined fraction of the output of the integrator 40, the voltage at the output terminal 66 remains at the high voltage level.

At time $t_6$, the trailing edge of the next reference pulse occurs at 10 degrees before top dead center of the respective cylinder (cylinder number 1 in this instance) to reset the output of the integrator 40 to ground and to enable the integrator 26 output to ramp as previously described. At the same time, the bilateral switch 54 is set to its high impedance state so that the voltage stored across the capacitor 56 at time $t_6$ is the predetermined ratio of the peak output of the integrator 40.

At time $t_7$, the output of the integrator 26 becomes equal to the output of the sample and hold circuit 42 representing a 35 degree rotation of the crankshaft since the trailing edge of the prior reference pulse. At this time, the crankshaft is at an angle of 25 degrees after top dead center of cylinder number 1. At time $t_7$, the comparator switch 62 generates the ground transition offset signal to ground the output terminal 66 via the bilateral switch 64 which was set to its low impedance state at time $t_5$ when an ignition pulse was supplied to the spark plug 12 of the reference cylinder number 1. This ground level transition at the output terminal 66 resets the flip-flop 72 via the inverter 73. When the flip-flop is reset, its Q output shifts to a low voltage state setting the bilateral switch 64 in its high impedance state at time $t_8$. At this time, the output terminal 66 is raised to the voltage V+. The ground level pulse at the output terminal 66 between the times $t_7$ and $t_8$ comprises the cam sync pulse at 25 crankshaft degrees after top dead center of the power stroke of cylinder number 1. From this point on, each of the reference pulses provided by the distributor can be identified with a respective one of the cylinders of the internal combustion engine since the ignition sequence of the engine is known. Since each of the reference pulses can be identified with a respective one of the cylinders, the fuel injection sequence of a port fuel injection system may be synchronized with the ignition pulse distribution sequence and timed relative to the reference pulses.

The specified location of the sync pulse at 25 degrees after top dead center of the reference cylinder is for illustration purposes only; other angles may be selected. However, the selected desired location of the cam sync pulse relative to top dead center of the reference cylinder should be such that the ignition pulse provided to that cylinder by the ignition system for all engine operating conditions precedes the selected location of the cam sync pulse. This provides for the generation of the cam sync pulse for all values of ignition timing including conditions wherein the ignition pulse for the reference cylinder occurs subsequent to the trailing edge of the reference pulse associated with that cylinder.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. In an internal combustion engine having multiple cylinders operated in a predetermined repeating sequence in synchronization with the rotation of a crankshaft and pursuant to a method including the steps of:

generating ignition pulses each having an engine operation dependent crankshaft angle relation to the top dead center crankshaft position of a respective one of the cylinders;

distributing the ignition pulses to the respective cylinders in the predetermined sequence, generating timing reference pulses each having a predetermined crankshaft angle relation to the top dead center position of a respective one of the cylinders, injecting fuel to the respective cylinders in the predetermined sequence in response to the timing reference pulses, and generating a sync pulse having a predetermined crankshaft angle relation to the top dead center crankshaft position of a designated one of the cylinders for the purpose of synchronizing the fuel injection sequence with the ignition pulse distribution sequence, the improvement comprising a method of timing the generation of the sync pulse including the steps of:

generating offset signals each having a predetermined crankshaft angle relation to a respective one of the timing reference pulses such that each offset signal has the same predetermined crankshaft angle relation to the top dead center position of a different associated one of the cylinders as the crankshaft angle relation required between the sync pulse and the top dead center crankshaft position of the designated cylinder, and such that each offset signal occurs after the occurrence of the ignition pulse for the associated cylinder;

sensing the occurrence of an ignition pulse distributed to the designated cylinder, and generating the sync pulse coincident with the occurrence of the offset signal next following the sensed ignition pulse.

2. A system for generating a sync signal at a desired engine crankshaft position relative to top dead center of a reference cylinder of a multicylinder spark ignited internal combustion engine having an output crankshaft and having an ignition system in which (A) reference signals are generated, each being associated with an unidentified respective one of the cylinders and being offset from top dead center thereof by a predetermined crankshaft angle, the reference signals being spaced by a crankshaft angle X as determined by the number of cylinders and (B) ignition signals are provided to each cylinder in timed relationship to the respective reference signals, each ignition signal being identified with a respective one of the cylinders, the system comprising:

means effective to generate repetitive ramp signals, each ramp signal being initiated and terminated by consecutive reference signals and attaining a peak amplitude representing the crankshaft angle X between reference signals;

peak follower means responsive to the ramp signals effective to generate a reference voltage having a magnitude equal to Y/X times the peak amplitude of the ramp signals, where Y is the crankshaft angle between the reference signal associated with the reference cylinder and the desired engine crankshaft position;

comparator means responsive to the ramp signal and the reference signal effective to generate a comparator output signal when the ramp signal becomes greater than the reference signal; and means enabled by the ignition signal identified with the reference cylinder effective to generate the sync signal coincident with the next generated comparator output signal, whereby the sync signal is repetitively generated at the desired engine crankshaft position relative to top dead center of the reference cylinder.

3. A system for generating a fuel injection sync signal at a desired engine crankshaft position relative to top dead center of a reference cylinder of a multicylinder spark ignited internal combustion engine having an output crankshaft and having an ignition system in which (A) reference signals are generated, each being associated with an unidentified respective one of the cylinders and being offset from top dead center thereof by a predetermined crankshaft angle, the reference signals being spaced by a crankshaft angle X as determined by the number of cylinders and (B) ignition signals are provided to each cylinder in timed relationship to the respective reference signals, each ignition signal being identified with a respective one of the cylinders, the system comprising:

means effective to repetitively measure the total time between reference signals, the total time measured representing the crankshaft angle X between reference signals;

means effective to generate a reference time signal representing a time period equal to Y/X times the total time measured between reference signals, where Y is the crankshaft angle between the reference signal associated with the reference cylinder and the desired engine crankshaft position;

means effective to generate a comparator output signal when the time since the last generated reference signal becomes greater than the time represented by the reference time signal; and means enabled by the ignition signal identified with the reference cylinder effective to generate the fuel injection sync signal coincident with the next generated comparator output signal, whereby the fuel injection sync signal is repetitively generated at the desired engine crankshaft position relative to top dead center of the reference cylinder to thereby establish identification between the reference signals and the cylinders for individual cylinder fuel control.

* * * * *